US009730305B2

(12) United States Patent
Domschat

(10) Patent No.: US 9,730,305 B2
(45) Date of Patent: Aug. 8, 2017

(54) ANTISTATIC DEVICE AND ASSOCIATED OPERATING METHOD

(71) Applicant: Gema Switzerland GmbH, St. Gallen (CH)

(72) Inventor: Klaus Domschat, Loerrach (DE)

(73) Assignee: Gema Switzerland GmbH (CH)

( * ) Notice: Subject to any disclaimer, the term of this patent is extended or adjusted under 35 U.S.C. 154(b) by 257 days.

(21) Appl. No.: 14/397,854

(22) PCT Filed: Apr. 30, 2013

(86) PCT No.: PCT/EP2013/058981
§ 371 (c)(1),
(2) Date: Oct. 29, 2014

(87) PCT Pub. No.: WO2013/164338
PCT Pub. Date: Nov. 7, 2013

(65) Prior Publication Data

US 2015/0296601 A1 Oct. 15, 2015

(30) Foreign Application Priority Data

Apr. 30, 2012 (DE) ..... 10 2012 207 219

(51) Int. Cl.
*H05F 3/00* (2006.01)
*H01T 19/04* (2006.01)
*H01T 23/00* (2006.01)

(52) U.S. Cl.
CPC ..... *H05F 3/00* (2013.01); *H01T 19/04* (2013.01); *H01T 23/00* (2013.01)

(58) Field of Classification Search
CPC ..... H05F 3/00; H01T 19/04; H01T 23/00
(Continued)

(56) References Cited

U.S. PATENT DOCUMENTS 3,619,615 A * 11/1971 Fish ..... B65H 37/00 250/359.1
6,504,700 B1 1/2003 Hahne et al.
(Continued)

FOREIGN PATENT DOCUMENTS

DE 19711342 A1 9/1998
DE 102006055121 A1 5/2007
(Continued)

OTHER PUBLICATIONS

English abstract for DE-102009033827.
English abstract for DE-102009053788.
English abstract for DE-102006005670.

*Primary Examiner* — Thienvu Tran
*Assistant Examiner* — Kevin J Comber
(74) *Attorney, Agent, or Firm* — Fishman Stewart PLLC

(57) ABSTRACT

An antistatic device for reducing electrostatic charges on moving material webs may include at least one active electrode assembly. The electrode assembly may include a plurality of active individual needle-shaped electrodes, which during operation may be electrically connected to an associated high voltage source. A controller may be included for controller the voltage source. The at least one active electrode assembly and the controller may be arranged in a housing. A signal device may be arranged at least one of in and on the housing. The signal device may include an optical indicator for outputting a signal to a user. The signal may correlate with at least one parameter of the material web. The at least one parameter may include a polarity of the material web.

19 Claims, 3 Drawing Sheets

(58) Field of Classification Search
USPC ..... 361/220
See application file for complete search history.

(56) References Cited

U.S. PATENT DOCUMENTS

| | | | | |
|---|---|---|---|---|
| 7,586,731 | B2 | 9/2009 | Sato et al. | |
| 2002/0003378 | A1* | 1/2002 | Marcus | B60C 23/0401 307/10.1 |
| 2004/0145852 | A1* | 7/2004 | Kraz | H01T 23/00 361/225 |
| 2005/0052815 | A1 | 3/2005 | Fujiwara et al. | |
| 2009/0219633 | A1 | 9/2009 | Li et al. | |
| 2009/0219663 | A1 | 9/2009 | Sato et al. | |
| 2011/0116204 | A1* | 5/2011 | Riskin | H01T 23/00 361/230 |
| 2012/0130204 | A1* | 5/2012 | Basta | A61B 5/746 600/301 |
| 2012/0200982 | A1* | 8/2012 | Partridge | B03C 3/68 361/213 |

FOREIGN PATENT DOCUMENTS

| | | | |
|---|---|---|---|
| DE | 102006005670 | A1 | 8/2007 |
| DE | 102009009863 | A1 | 9/2009 |
| DE | 102009033827 | B3 | 3/2011 |
| DE | 102009053788 | A1 | 6/2011 |

* cited by examiner

ANTISTATIC DEVICE AND ASSOCIATED OPERATING METHOD

CROSS-REFERENCE TO RELATED APPLICATIONS

This application claims priority to German Patent Application No. 10 2012 207 219.5, filed Apr. 30, 2012, and International Patent Application No. PCT/EP2013/058981, filed Apr. 30, 2013, both of which are hereby incorporated by reference in their entireties.

TECHNICAL FIELD

The present invention relates to an antistatic device for reducing electrostatic charges of moving material webs as well as a method for operating such an antistatic device.

BACKGROUND

If two materials move relative to each other one of these materials may build up an electrostatic charge or, in short, become electrostatically charged due to the electric charge present in the respective materials. Such an electrostatic charge occurs particularly frequently in materials in which conductivity is weak or non-existent, in particular in dielectric materials. The build-up of such an electrostatic charge usually leads to a corresponding electrostatic discharge, wherein high energies, in particular electric energies are released. This may take the form of sparks or of momentarily flowing high electric currents. Such a discharge is known to be a danger to persons who happen to be present in its environment or to objects in its vicinity, and may also damage and/or destroy the electrostatically charged material or the material in the process of discharging and it could also trigger a fire or explosion. Electrostatic charges and corresponding discharges in particular occur in moving thin material webs, in particular in films, fleeces, textiles, threads, granulates, powder and paper as well as in a mixture of such materials which may, for example, be moving at high speed as a rule, in an associated production plant or processing plant. In particular the electrostatic discharge may lead to injury for an operator of the plant as well as to damage to the plant and the material or the material web itself. In addition, when such materials build up a charge, which in particular may occur in the form of a polarized surface, problems may occur during after-treatment or post-processing of these materials, for example if these materials undergo subsequent coating and/or printing. In order to counteract this electrostatic build-up of a charge or its discharge, an antistatic device is usually provided which ensures controlled discharging or electric neutralization of the electrostatically charged material. As a rule the charge causing the electrostatic charge is removed from the moving material web by means of the antistatic device. It is conceivable to achieve such a reduction of electrostatic charges with the aid of electrodes which are connected to a corresponding high voltage source and thus to build up an electric potential relative to the material web, in order to achieve said removal of the charge.

An antistatic device of this kind is for example known from the DE 197 11 342 A1. The antistatic device which comprises such electrodes can be connected to an external high voltage source in order to build up the electric potential between the electrodes and the material web.

SUMMARY

The present invention addresses the problem of proposing an improved or at least alternative embodiment for an antistatic device mentioned in the beginning, which is characterized, in particular, by a simplified handling and/or improved operability and/or a reduced dimensioning and/or an optimized energy requirement and/or a simple, preferably optic or acoustic, representation of electrostatic processes.

According to the invention this problem is solved by the objects of the independent claims. Advantageous embodiments are the subject of the dependent claims.

The present invention is based on the general idea to arrange as many components of an antistatic device as possible and required for the operation, within a common housing in order to create a space-saving antistatic device on the one hand and on the other, to achieve improved operability and/or improved operation and/or improved handling of the antistatic device. This has the effect, in particular, of reducing the amount of work involved with connecting the antistatic device to external components, i.e. to components or supply units external to the housing, to just one single feed line.

Based on the inventive idea, such an antistatic device comprises at least one active electrode assembly, which comprises several, preferably needle-shaped, individual electrodes, and which when the antistatic device is running, is electrically connected to an associated voltage source. Conveniently the voltage source is configured as a high voltage source, in order to be able to apply a corresponding high voltage to the electrode assembly. The voltages involved are usually approx. 1000V and higher. In the following the voltage source is therefore called a high voltage source, although it is clear that the voltage source may also supply lower voltages. Furthermore the antistatic device comprises a controller which controls the high voltage source connected to the electrode assembly. According to the invention the at least one active electrode assembly and the controller are arranged in the housing.

Preferably the high voltage source is also arranged in the housing of the antistatic device. This enables handling of the antistatic device to be improved even further, in particular because the separate connection of the antistatic device to the high voltage source, in particular by a user of the antistatic device, may be omitted.

The electrode assembly and in particular the individual electrodes serve the purpose of building up an electric potential relative to the moving material web, in order to reduce the electrostatic charge of the material web. To this end an electric resistance may be arranged upstream of the respective electrode. Conveniently the controller is configured or programmed such that, by controlling the high voltage source, it builds up an electric potential of a kind which leads to a reduction of the electrostatic charges on the material web. In particular provision may be made for a negative high voltage to be applied to the electrodes if the electrostatic charges on the material web are positive, and the material web is thus charged positively. Correspondingly provision may also be made for a positive charge to be applied to the electrodes of the electrode assembly if the electrostatic charges on the material web are negative and the material web is thus negatively charged. In both cases the electrostatic charges are preferably removed from the material web, causing the electrostatic charges on the material web to be reduced and neutralized as far as possible.

In principle, the material web can be any size and consist of any given material. In particular the material web may be a web consisting of paper, film or the like.

In preferred embodiments the antistatic device may comprise two such active electrode assemblies, i.e. an active positive electrode assembly with several active needle-shaped individual positive electrodes and an active negative electrode assembly with several active needle-shaped individual negative electrodes. Conveniently the positive electrode assembly is connected to a high voltage source which is positively charged and therefore is called a positive high voltage source, whilst the negative electrode assembly is connected to a negative high voltage source which is called a negative high voltage source. According to the invention the positive electrode assembly and the negative electrode assembly are both arranged in the housing of the antistatic device.

The respective positive electrodes and negative electrodes may be arranged along parallel lines. Also embodiments are feasible, where the positive electrodes and the negative electrodes are arranged alternately along a common line. Such a layout of an antistatic device leads to a further reduction in the space required for the antistatic device because there is no need for either the respective positive electrode assembly or the negative electrode assembly would be housed.

According to an advantageous embodiment the antistatic device comprises a power electronics which is also arranged in the housing. The power electronics in particular serves the purpose of converting an electric primary supply available to the antistatic device in accordance with the requirements necessary for operating the antistatic device. The electric primary supply is normally a generally available electric supply, in particular in the form of an electric current or an electric voltage which can be drawn from an ordinary power socket of an electric network operator. This could, for example, be a low voltage network, in which a voltage with a value of 24 VDC or 90-400 VAC is made available at frequencies between 50 and 60 Hz, which are converted by the power electronics into the required voltages, currents and frequencies required for the operation of the antistatic device, in particular the respective active electrode assembly. In particular the power electronics may comprise at least the respective high voltage source, i.e. in particular a positive high voltage source and/or a negative high voltage source.

Conveniently the power electronics comprises at least one voltage converter which converts a primary voltage supplied by the electric primary supply into a secondary voltage. For example, the voltage converter converts the primary voltage available as a low voltage into a medium voltage and/or a high voltage and makes this e.g. available to the electrode assembly. Accordingly such a high voltage source is connected with the power electronics or may, in particular, be the power electronics or a part thereof. Further the power electronics may comprise at least one voltage converter for the respective electrode assembly or the respective high voltage source. This means that the power electronics may comprise at least one such voltage converter for the positive electrode assembly or the positive high voltage source and at least one other such voltage converter for the negative electrode assembly or the negative high voltage source.

Also the power electronics may comprise at least one frequency converter which converts a primary frequency of the primary voltage made available by the electric primary supply. In particular such a frequency converter may reduce and/or increase the primary frequency of the primary voltage. This means that a primary alternating voltage can be converted into a direct voltage and/or into a voltage with a frequency different from the primary frequency of the primary voltage. Analogously to the voltage converter the respective electrode assembly may have such a separate frequency converter of the power electronics associated with it.

In particular the power electronics may comprise at least one direct voltage converter (DC-DC) and/or one inverter (AC-DC).

Conveniently the power electronics is connected with a controller, preferably said controller, for electrically supplying the antistatic device, in particular the at least one active electrode assembly, according to the respective requirements. The controller may be configured or programmed so as to drive the power electronics and in particular the respective high voltage source in such a way that a voltage required for reducing the electrostatic charge of the material web, is applied to the at least one electrode assembly, in particular to the associated electrodes.

Preferably the antistatic device comprises at least one primary connection for connecting the antistatic device to an external voltage source In particular the external voltage is the said electric primary supply which conveniently is a low voltage source. The at least one primary connection is arranged on the housing of the antistatic device. This allows the antistatic device to be e.g. connected, in particular by means of an electric cable, to a commonly used electric port such as a commonly known socket which can be found in any household or industrial premises. By arranging the power electronics in the housing of the antistatic device there is then no need for any electric units to be arranged external to the housing, such as voltage converters and/or frequency converters.

According to a further preferred embodiment the antistatic device comprises a sensor system which is used for capturing parameters of the antistatic device and/or of the material web. Further the sensor system may be used to capture parameters of an associated production plant. Conveniently the sensor system is connected with the controller, allowing the parameters captured by the sensor system to be passed onto the controller which then processes them further. In particular the controller may be configured or programmed in such a way that it controls the power electronics and/or the high voltage source by way of the parameters captured with the aid of the sensor system. The parameters captured by the sensor system may comprise, for example, an operating state of the antistatic device and/or of the material web and/or of the production plant. Accordingly the sensor system is able to capture the speed at which the material web moves and in particular, as to whether the material web is stationary without moving. Moreover the sensor system may be configured or developed such that it can capture a polarity of the material web. Alternatively or additionally the sensor system may be configured or developed such that it can capture a neutralization current which is flowing at the at least one active electrode assembly as a result of reducing the electrostatic charges on the material web.

Advantageously the sensor system can also capture the voltages and/or currents made available by the power electronics of the respective electrode assembly and/or by other components of the antistatic device. To this end the sensor system may be connected in particular to the power electronics and/or the respective high voltage source and/or the respective electrode assembly. Preferably the sensor system is also arranged in the housing of the antistatic device.

The sensor system may comprise, in particular, a sensor electrode assembly comprising several needle-shaped individual sensor electrodes and, with the antistatic device in operation, is electrically connected to a grounding, in particular an earth. Due to the sensor electrode assembly the said neutralization current and/or the polarity of the material web can be captured.

To improve the operability of the antistatic device and/or its safety the antistatic device preferably comprises a signal device arranged in or on the housing. The signal device may be configured or developed in such a way as to output a signal in dependence of at least one parameter of the antistatic device and/or the material web and/or the production plant, wherein the parameter may be captured in particular by the sensor system. In other words: the signal device is used in this instance to output the at least one signal representing such a parameter of the antistatic device and/or the material web and/or the production plant. Thus the operating state of the antistatic device and/or the material web and/or the production plant may be signaled to a user with the aid of the signal device. Further the signal device may be used to signal to the outside, whether the antistatic device and/or the production plant requires to be modified and/or maintained and/or repaired.

In principle the signal may be output acoustically or electrically. This means that the signal device outputs one or more acoustic signals in order to reflect directly or indirectly, at least one such parameter of the antistatic device and/or on the material web or the associated plant for a person.

Alternatively or additionally, as mentioned previously, the emission of the signal is effected electrically, wherein preferably a so-called active-high emission of the signal takes place. In particular this means that the electric signal is output with an essentially constant value, e.g. with 24 VDC, and reduced and in particular interrupted in order to reflect the corresponding parameter of the antistatic device and/or the material web and/or the plant. In particular, it is thus ensured that a failure of, and/or a fault in, and/or an error of, the antistatic device and/or the associated plant can be represented and determined by a reduction or interruption of the electric signal.

In order to output the respective signal, the signal device may communicate with, and in particular activate, a further unit of the antistatic device, which may be arranged inside or external to, the housing, or with another unit. In particular the electric signal may be output by a unit which in turn outputs a signal which correlates with the signal output by the signal device.

Conveniently the signal device is coupled to a controller, in particular said controller, wherein the controller is configured and/or programmed in such a way that it drives the signal device in dependence of at least one such parameter of the antistatic device and/or the material web.

In further preferred embodiments the signal device comprises an optical indicating means. This means that reproduction of the signal is effected optically, i.e. by means of one and/or more optical signals. The optical indicating means may extend along a longitudinal extension of the housing in order, in particular, to achieve an optimal reproduction of the signal and/or to utilize a large area of the housing for reproducing the signal. Preferably the optical indicating means is arranged within or on the housing. Or the optical indicating means may be fitted or arranged in a wall of the housing, i.e. form part of the housing.

With further preferred embodiments the indicating means extends circumferentially in/on the housing, at least in sections. This means that the indicating means extends along at least two adjacent lateral surfaces of the housing. It is thus possible to observe the indicating means from at least two different sides of the antistatic device or the housing. Advantageously the indicating means extends all the way in or on the housing so that it can be observed from all sides of the housing. In particular it is possible to imagine designs where the housing itself serves as an indicating means or as part of an indicating means and can thus be used for indicating the state of the antistatic device and/or the material web and/or the associated production plant.

The housing may be configured so as to be at least partially translucent, i.e. at least partially optically transparent. This means that the housing may optically translucent at least in sections and/or in optically partially transparent in sections. Conveniently the optical indicating means is arranged in such a translucent area of the housing in the housing in order to make the optical signals output by the optical indicating means visible from outside the housing. The housing is therefore used as part of the indicating means or serves as an indicating means.

The translucent configuration of the housing may be realized either from inside to outside or from outside to inside. This means that the housing may be configured in the respective areas so as to be translucent from inside to outside and/or from outside to inside.

Further the housing may be filled with a casting compound in which for example the two electrodes are arranged and are electrically contacted. Conveniently the electrodes are arranged on an underside of the housing, which underside is open. It is conceivable to make the casting compound translucent, at least in sections so that the optical indicating means can be arranged in/on the casting compound, thereby enabling the signal to be visible in particular from the underside of the housing.

It is also conceivable to cast the housing or a profile of the housing so that it is at least partially translucent or transparent in order to utilize the housing for the indicating means.

The optical indicating means may be configured such that it can output at least two different optical signals. As such the optical indicating means may indicate e.g. two different colors and be configured as an RGB display. Further the optical indicating means may comprise at least one light-emitting diode (LED) and/or a pixel matrix which for example may be configured in the form of an active matrix display from LEDs or as a liquid crystal display (LCD). It is understood that the optical indicating means can output the optical signals using random illuminating units. These include for example said LEDs and/or LCDs and glow lamps, fluorescent tubes and the like. The indicating means therefore may comprise in particular RGB-LEDs and/or at least a LCD matrix. The signal-emitting components of the indicating means, i.e. in particular the LEDs and/or LCD matrices, may be cast at least partially in the profile of the housing.

Preferably the housing is configured and, in particular, is translucent in sections such that the optical indicating means, viewed from the outside, is visible from at least two different sides of the housing. The housing and/or the indicating means therefore may be configured such that an observer or an operator or a user can observe the optical signals signaled by the optical indicating means from opposite sides of the housing and/or from adjacent sides of the housing. Embodiments are also feasible where the optical signals are visible on three or more sides of the housing. This is the case in particular when using the translucent casting compound, where the optical signals are also visible from the underside of the housing.

With a translucently configured housing, at least in sections, and/or with a translucent casting compound the electric components of the antistatic device arranged in the housing such as in particular the power electronics and/or the respective high voltage source and/or electric resistances and the like may be arranged in a section other than the translucent section of the housing. In this case the antistatic device may be operated in particular according to the method described below.

The Signal output by the signal device may for example be output in dependence of the polarity of the neutralization current or the value of the neutralization current and/or in dependence of the polarity of the material web. Also the signal may be output in dependence of the operating state of the antistatic device and/or the material web.

Preferably different signals are output for different parameters of the antistatic device and/or the material web and/or the production plant. In particular the optical indicating means of the signal device may output, in dependence of such parameters of the antistatic device and/or the material web and/or the production plant, different colors or color combinations and/or colored texts, in particular by means of an RGB matrix. The output of different color combinations can be effected in that at least two colors are displayed at the same time or in that two different colors are displayed one after the other in terms of time. When using such a RGB display for example at least eight colors can be output, in particular pink, blue, green, bright yellow, dark yellow, orange, bright red and dark red.

It is also conceivable, in dependence of such parameters of the antistatic device and/or the material web and/or the production plant, to output different frequencies of the respective signal. This means that the signal device, in dependence of said parameters, outputs acoustic signals at different frequencies and/or optical signals at different frequencies. Also the signal device, in particular if a danger threatens, can output a corresponding acoustic and/or optical warning. Such a warning may be output acoustically in the form of spoken words issuing a corresponding warning or in the form of an alarm. The optical warning may be signaled, for example, by a respective color, in particular red, and be reinforced and/or emphasized, for example, at a repeating frequency.

It is also conceivable to equip the antistatic device with two or more such indicating means in order to achieve a greater variety of signals which can be output by the signal device, and/or to improve visibility of the optical signal. As such the respective indicating means can output different or identical optical signals simultaneously or alternately.

Preferably the signal device is configured such that it can output a variety of different signals, wherein the respective signal advantageously correlates with an associated parameter or state of the antistatic device and/or the material web and/or the associated production plant.

Advantageously signal output is effected by the indicating means predominantly in the form of different color displays. Displaying different colors has the advantage that in order to associate a parameter or state of the antistatic device and/or the material web and/or the associated production plant, no particular language skills or technical skills are necessary. This means that the colors can be selected such that they can be universally and intuitively understood.

Purely as an example the indicating means can indicate the following colors and/or color combinations: The indicating means outputs a red signal if the discharging power and/or the neutralization current or the electrodes is/are positively or predominantly positively polarized. A blue signal is output if the discharging power and/or the neutralization current or the electrodes is/are negatively or predominantly negatively polarized. The intensity of the signal output, such as, in this case, the light intensity and/or the color intensity, may depend on the value of the polarity. It is also conceivable that the color-dependent output is effected with reference to the material web. This means that a red signal is output if the material web is predominantly positively charged, and that a blue signal is output if the material is predominantly negatively charged. The output of these signals may be continuous, i.e. without flashing, or discontinuous, i.e. flashing. It is also conceivable that when the antistatic device and/or the material web and/or the associated production plant is started or switched on, a green signal is initially output, provided the antistatic device and/or the material web and/or the associated production plant are in a desired state. If a fault occurs or if a reduction in power of the electrodes, possibly due to contamination, is determined or detected, the display of the color signaling the polarization of the material web or the antistatic device can initially be interrupted by another color or color combination. The blue or red signal can therefore be interrupted by a yellow or yellow-green signal. As the reduction in power or intensity of the fault increases the frequency of interruption can be increased until finally only the color or color combination signaling the fault is displayed. Thus it is possible to signal to the operator or the user, in a simple, language-independent and intuitive manner, the state of the antistatic device and/or the material web and/or the associated production plant. The respective color output can, of course, be supplemented by a text display, which for example may be effected by the same LEDs and/or by other LEDs and/or by a LCD matrix. The text display may be permanent or at a frequency, i.e. flashing. The text display may also be continuous or rigid. The respective text may be output in a common language such as English. For example, if the electrodes start to lose power, the text "Clean bar" can be displayed at a changing frequency until the text is finally displayed continuously, wherein the change in frequency may be continuous and/or in steps.

Further provision is advantageously made for the indicating means to be provided in/on an essential part of the housing so that the housing is lit as a whole or essentially as a whole as a result of the optical signal output and can thus be very clearly seen.

In a further preferred embodiment the antistatic device comprises an environmental sensor unit for detecting environmental parameters. The environmental sensor unit can for example, detect an environmental light intensity and/or an environmental sound intensity. The environmental sensor unit in particular serves the purpose of varying the strength of the signal output by the signal device. The environmental sensor unit may be arranged in or on the housing or external to the housing. Conveniently the environmental sensor unit may be connected with the controller in order to achieve said variation in the strength of the signal output by the signal device. In this way the sound intensity of the acoustic signal output by the signal device may be adapted to the environmental sound intensity and in particular be selected so as to be still perceivable whilst taking into account the environmental sound intensity. It follows that the sound intensity of the acoustic signal output by the signal device is greater than the environmental sound intensity. Also the light intensity of the optical signal output by the signal device is selected such that it remains recognizable despite the environmental light. In this way it is ensured on the one hand that the signals output by the signal device are detectable at any time and that on the other, the energy demand of the signal device is reduced because the strength of the signal, i.e. in particular the sound intensity of the acoustic signal and/or the light intensity of the optical signal can be reduced given appropriate environmental parameters.

Conveniently the antistatic device may comprise one or more communications interfaces. Such a communication interface is used for the communication of the antistatic device with another communications device. The communications device may for example be a computer, a controller, an operator panel or the like. In particular the communications device permits a read-out of the parameters of the antistatic device by means of the communications interface. As such it permits communication with the controller so that, in particular, the programming of the controller can be changed, activated, deactivated or similar. The respective communications interface may therefore be a communications port arranged on/in the housing, such as a USB port. The communications interface may be configured, in particular, as a wireless communications interface which permits wireless communication, i.e. in particular wireless transmitting and/or receiving of signals and/or communication data. Such a communications interface may therefore be configured in particular as a wireless LAN (WLAN) interface and may communicate with a random unit. Due to the wireless communications interface there is therefore no need for an appropriate connection via a cable or the like so that handling of the antistatic device is further improved. Moreover this improves communication with a respective device, e.g. a communications device of this kind. In particular the wireless communications interface permits access to the antistatic device without requiring a direct physical connection, in particular by means of a cable. In particular outputting the signal by the signal device may be effected via the wireless communications interface. The wireless communications interface can transmit the signal output by the signal device to a further unit, for example a communications device of this kind, where for example it is further processed and/or output. This output may for example be effected acoustically and/or optically and/or haptically.

In further embodiments the wireless communications interface may be connected with other components of the antistatic device thereby enabling communication with these components of the antistatic device to be carried by means of the wireless communications interface. As such it is conceivable to allow the controller to communicate with the wireless communications interface with a view to changing and/or activating and/or deactivating and/or programming and/or reprogramming of the controller by means of the wireless communications interface. Insofar access to the antistatic device can be effected also remotely, in order to, for example, change the voltage applied to the electrodes, read out parameters of the antistatic device and/or the associated production plant and/or the material web, and determine or change threshold values for the output of the respective signal.

In principle the wireless communications interface may communicate wirelessly by means of electromagnetic rays of any kind. This means that the wireless communications interface is designed or configured such that it can send and/or receive data at any frequency. The wireless communications interface may function, as mentioned previously, like a WLAN and may thus be linked into a possibly already existing data network. Communication with the associated device, in particular a communications device of this kind, may be effected via a data node, in particular a router or the like. It is also conceivable to design or equip the wireless communications interface such that it communicates according to the Bluetooth® standards. Similarly the wireless communications interface may be configured such that it communicates with the aid of infrared rays and therefore comprises an infrared interface and is configured as such an interface.

The wireless communications interface is further designed or configured so as to allow the data sent via the wireless communications interface and/or the data received from the wireless communications interface to be coded in the known manner or in a random manner. For examples of such coding reference should be made to the ASCII coding.

In order to increase transmission safety via the wireless communications interface the wireless communications interface may be configured so as to ensure encryption of the data sent from, and received by, the wireless communications interface. This is to prevent unauthorized access to the wireless communications interface and thus in particular to the controller. Such an encryption may be ensured, for example, by a SSL protocol and/or a TLS protocol.

Alternatively or additionally improved transmission safety may be effected by a secure connection between the wireless communications interface and the associated device, in particular said communications device, wherein the communications device is equipped accordingly. Such a secure connection may, for example be ensured by means of an appropriate password or access code.

The antistatic device may, of course, comprise several wireless communications interfaces. Embodiments are also conceivable, in which the wireless communications interface communicates with several communications devices, respectively either in the same way or in a different way, i.e. in particular at the same frequency or at different frequencies and/or coded or not coded.

It is pointed out that the production plant may be any type of plant which moves the material web as part of the manufacture and/or as part of processing. The production plant therefore may be a coating plant, in particular a printing plant or similar.

It is understood that the housing may be configured according to the conditions prevailing in its area of use. Therefore the housing may be configured such that it is protected against liquids in order to protect the electrical components of the antistatic device arranged in the housing. In particular the housing may be in compliance with the requirements of protection class IP68.

Further important features and advantages of the invention are revealed in the sub-claims, the drawings and the associated description of the figures with reference to the drawings.

It is understood that the features mentioned above and to be explained below can be used not in only in the respectively given combination but also in other combinations or on their own without leaving the scope of the present invention.

Preferred embodiments of the invention are illustrated in the drawing and will be explained in detail in the description below, wherein identical reference symbols refer to identical or functionally identical components.

BRIEF DESCRIPTION OF THE DRAWINGS

In the schematically drawn figures.

DETAILED DESCRIPTION

Figure 1:
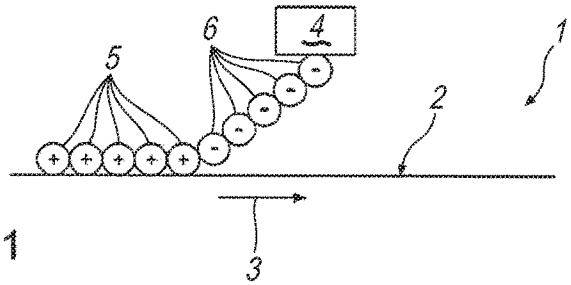
FIG. 1 shows a strongly simplified view of a production plant in the area of an antistatic device.

FIG. 1 shows a production plant 1 in which a material web 2 is moved in a movement direction 3. The production plant 1 comprises an antistatic device 4, with the aid of which an electrostatic charge on the material web 2 is reduced and preferably eliminated or neutralized. Purely as an example five positive charge units 5 are indicated in FIG. 1 upstream of the antistatic device 4 on the material web 2 with reference to a movement direction 3, which are existent on the material web 2 for production reasons. In the area of the antistatic device 4 five negative charge units 6 are indicated, which are generated with the aid of the antistatic device 4 and which cause neutralization of the five positive charge units and remove these. In the ideal case illustrated the material web 2, with reference to its movement direction 3, is charge-free or charge-neutral downstream of the antistatic device 4.

Figure 2:
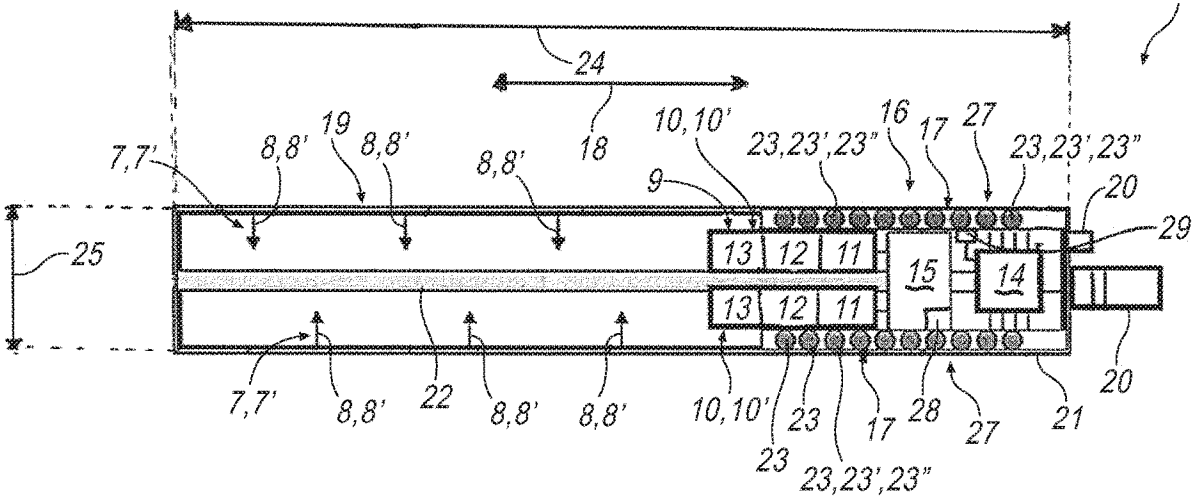
FIG. 2 shows a section through an antistatic device in a top view.

According to FIG. 2 an antistatic device 4 comprises at least one active electrode assembly 7, wherein the shown electrode assembly 7 comprises two such active electrode assemblies 7, i.e. one active positive electrode assembly 7' and one active negative electrode assembly 7". The respective electrode assembly 7 comprises several needle-shaped electrodes 8, wherein in the shown embodiment three needle-shaped electrodes 8 are shown for each electrode assembly 7, purely as an example. The positive electrode assembly 7 comprises positive electrodes 8', whilst the negative electrode assembly 7 comprises negative electrodes 8". Each electrode assembly 7 is supplied with an electric voltage from a power electronics 9 provided in the antistatic device 4, wherein the power electronics 9 comprises to units 10, of which one unit 10' is electrically connected with the positive electrode assembly 7' whilst the other unit 10" is electrically connected with the negative electrode assembly 7". The respective unit 10 comprises a frequency converter 11, a voltage converter 12 and a high voltage source 13. With the aid of the power electronics 9 a primary voltage made available by an electric primary supply is converted into a voltage required by the respective electrode assembly 7. Thus the respective unit 10 of the power electronics 9 is able to convert the primary voltage into another, in particular a higher voltage. For example the voltage converter 11 can convert the primary voltage into a high voltage and make this available to the associated electrode assembly 7 with the aid of the respective high voltage source 13. A change in the frequency of the primary voltage is effected with the aid of the respective frequency converter 12, wherein the respective frequency converter 12 can convert an alternating primary voltage into a direct voltage or a voltage with another frequency and vice versa. The voltage converter 11 and the frequency converter 12 may both be configured as inverters. Also, the high voltage source 13 may be configured together with the voltage converter 11 and/or the frequency converter 12. The unit 10' of the power electronics 9, in particular the associated voltage converter 11 and/or the frequency converter 12, is designed or configured such that it makes a positive voltage available to the positive electrode assembly 7'. Further the other unit 10" of the power electronics 9, in particular the associated voltage converter 11 and/or the frequency converter 12, is designed or configured such that it makes a negative voltage available to the negative electrode assembly 7".

The power electronics 9, in particular the voltage converter 11, converts common-household voltages which normally lie in the low voltage range between 100 and 400V, into a high voltage which may lie in the range between 1000V and a few thousand volts.

Moreover, the antistatic device 4 comprises a controller 14 for controlling the respective unit 10 of the power electronics 9, in particular the respective high voltage source 13. To this end the controller 14 is connected to the respective unit 10 of the power electronics 9. Furthermore the antistatic device 4 comprises a sensor system 15 which can detect parameters of the antistatic device 4 or the production plant 11 and of the material web 2 and forward these to the controller 14. For example the sensor system 15 can detect a neutralization current flowing through the charge units 6 of the electrode assembly 7 based on the reduction or neutralization of the charge units 5 of the material web 2. Further the sensor system 15 can detect the voltage applied to the respective electrode assembly 7 and/or a speed of movement and/or direction of movement 3 of the material web 2. Further the sensor system 15 is able to detect an operating state of the antistatic device 4 as well as of the production plant 2. To this end the sensor system 15 is designed and equipped in the known manner. In particular the sensor system 15 may be connected to the production plant 1 and/or to the power electronics 9 and/or to the respective electrode assembly 7 or the respective electrode 8.

The antistatic device 4 further comprises a signal device 16 which in the example shown comprises two optical indicating means 17. The respective optical indicating means 17 extends along a longitudinal extension 18 of a housing 19 of the antistatic device 4 and is arranged in the housing 19. The signal device 16 is used to output a signal in dependence of parameters of the antistatic device 4 and/or the production plant 1 and/or the material web 2, which have been detected in particular via the sensor system 15, wherein the optical indicating means 17 outputs optical signals.

As can be seen in FIG. 2, the electrode assembly 7', 7", the controller 14, the sensor system 15 as well as the power electronics 9 and the signal device 16 are all arranged in the housing 19 of the antistatic device 4. This permits a compact and space-saving design of the antistatic device 4. Moreover there is now no need for connecting the antistatic device 4 to components external to the housing 19, such as electrical components such as voltage converters and the like, making it possible to connect the antistatic device 4 to just a normal electrical port such as a socket or similar and thus rendering it operable.

The antistatic device 4, in the embodiment shown, comprises two primary connections 20 for connecting the antistatic device 4 to an external voltage source which in particular may correspond to a normal electrical connection of an industrial plant or a household-type voltage source offering a primary voltage. The primary connections 20 are arranged on an outside face 21 of the antistatic device 4 thereby making them accessible from outside and making it easy to connect the antistatic device 4 to an electric primary supply.

Furthermore a central web 22 is arranged within the housing 19 of the antistatic device 4, which web extends along the longitudinal extension 18 between the electrode assemblies 7', 7" and the units 10', 10" of the power electronics 9. The central web 22 is made of an electrically insulating material in order to ensure the electrical isolation between the positive electrode assembly 7' and the negative electrode assembly 7" as well as between the units 10', 10" of the power electronics 9 and thus in particular to prevent short-circuits or the like between these components of the antistatic device 4. The central web 22 is preferably shaped in such a way that it protrudes beyond the electrodes 8 or their tips.

The controller 14 is configured or programmed to enable it to drive the respective unit 10 of the power electronics 9 in particular in dependence of the polarity of the material web 2 and/or of the neutralization current. As such, for example, only the positive electrode assembly 7' may be supplied with a positive voltage if the polarity of the material web 2 is negative. Similarly only the negative electrode assembly 7" may be supplied with a negative voltage if the polarity of the material web is positive. The controller 14 may also be used to control or alter the signal output by the signal device 16 or the respective optical indicating means 17. The controller 14 alters the optical signal output by the respective optical indicating means 17 in dependence of said parameters of the antistatic device 4 and/or the production plant 1 and/or the material web 2.

In the example shown the respective optical indicating means 17 comprises, purely as an example, ten illuminating units 23, which may e.g. each be configured as a light-emitting diode 23' or a pixel matrix 23". The respective optical indicating means 17 is able to represent at least two different colors. This can e.g. be realized in that at least two illuminating units 23 output different colors or that at least one of the illuminating units 23 outputs different colors. The respective optical indicating means 17 may therefore be configured in particular as a RGB LED strip. In particular the controller 14 may drive the respective optical indicating means 17 in such a way that different color combinations and/or frequencies or repetition rates can be output. For example the respective optical indicating means 17 may output a yellow or green-yellow signal, if there is a fault in the antistatic device 4 and/or the production plant 1. Further the respective optical indicating means 17 may signal the polarity of the material web 2 or the electrodes 8 with a corresponding color. As such the respective optical indicating means 17 could e.g. show blue if the material web 2 or the electrodes 8 comprise a negative polarity, and red if the material web 2 comprises a positive polarity or vice versa. Also a flashing signal may be used to warn of, or point to, a fault or of a repair or maintenance which is due or will be due soon. As such the respective optical indicating means 17 may e.g. flash if such an electrode 8 or several such electrodes 8 have to be replaced due to contamination or the like. This can be indicated by a corresponding colour such as yellow or yellow-green. By contrast the respective optical indicating means 17 may show green if there is no fault and/or if the electrostatic charge of the material web 2 is reduced or neutralized. In particular green may be shown on switch-on or start-up of the antistatic device 4 and/or the material web 2 and/or the production plant 1 and then be replaced by the color representing the polarity, i.e. in particular red or blue. The display or output of the color reflecting the polarity is continuous, i.e. not flashing, until a fault occurs, for example in the form of increasing contamination of the electrodes 5. Thereafter the polarity display is interrupted at specified frequencies by a color or color combination signaling this fault, for example yellow or yellow-green. As the intensity of the fault, in particular an increasing contamination of the electrodes 8, increases, the frequency changes to the extent that eventually, when e.g. maintenance is due, only the color signaling the fault, in particular yellow or yellow-green, is output. Thus the state of the antistatic device 4 and/or the material web 2 and/or the production plant 1 can be intuitively recognized without the need for special language skills or technical skills. The indicating means 17, in particular the diodes 23', can be used to optically represent a text. Text output and color output can, of course, be randomly combined.

Figure 3:
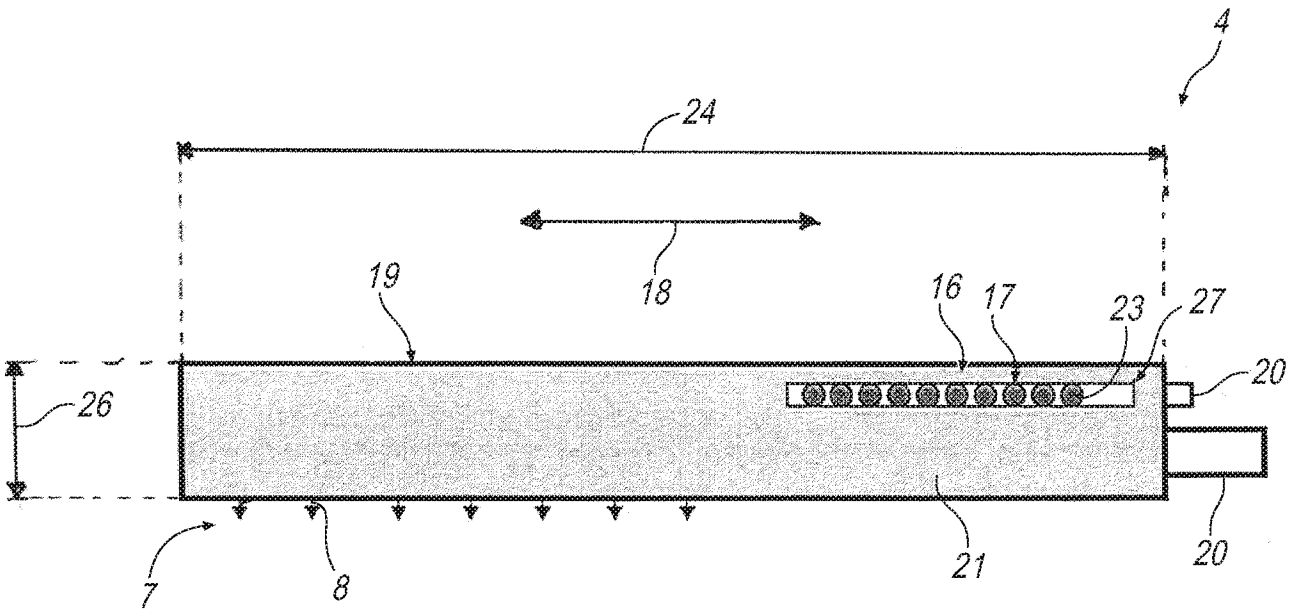
FIG. 3 shows a lateral view of the antistatic device.

In principle the antistatic device 4, in particular the housing 19, may have any given dimensions. For example a length 24 of the housing 19 extending along the longitudinal extension 18 may be e.g. between 300 mm and 2000 mm, preferably between 300 mm and 600 mm. Also a width 25 of the housing 19 may be in particular 20 mm to 25 mm, whilst a height 26 (see FIG. 3) of the housing 19 is preferably between 30 mm and 35 mm.

The respective optical indicating means 17 is arranged in the housing 19 in a translucent area 27 of the housing 19 so that it is visible from outside and the optical signals output by it are observable. The respective optically translucent area 27 of the housing 19 is shaped so as to complement the associated optical indicating means 17 and thus comprises a strip-like form. In addition the housing 19 comprises such an associated translucent area 27 both on the top surface shown in FIG. 2 and on the side surface to the respective optical indicating means 17, thus enabling the respective illuminating unit 23 of the associated optical indicating means to be visible both from the top surface and from side surface of the housing 19.

According to FIG. 2 the antistatic device 4 further comprises an environmental sensor unit 28 which can detect environmental parameters of the antistatic device 4 and/or production plant 1. For example the environmental sensor unit 28 may detect an environmental sound intensity and/or an environmental light intensity. These environmental parameters ascertained by the environmental sensor unit 28 are communicated to the controller 14, and the controller 14 adjusts the light intensity of the optical signal output by the respective optical indicating means 17 such that it is recognizable despite the environmental light intensity.

Furthermore a wireless communications interface 29 can be recognized in FIG. 2, which is arranged in the housing 19 and is connected with the controller 14. It would also be possible to attach the wireless communications interface 29 to the outside of the housing 19. With the aid of the wireless communications interface 29 it is possible to communicate with an external communications device, e.g. with a computer, a controller or the like, wherein this communication and therefore the sending and receiving of communication data or data is effected wirelessly. This means that there is no longer any need for a physical connection of the antistatic device 4 with said communication device, thus further improving handling of the antistatic device 4.

The wireless communications interface 29 may, for example, be used to remotely reprogram the controller 14 in order to change the voltage applied to the electrodes 8. Also the signals output by the signal device 16 may be influenced in that, for example, threshold values affecting the signal output or the signals themselves are changed. Further with the aid of the wireless communications interface 29 the parameters may be transmitted to the associated communication device without the need for a physical connection, in particular a cable.

Further the output of the signal may also be effected by means of the signal device 16 via the wireless communications interface 29, which forwards the respective data to an external device which outputs a signal which correlates with the signal output by the signal device 16. This means that e.g. a remote location, which the signal of the signal device 16 cannot reach, in particular a remote space or room, can be supplied with the signal.

Figure 4:
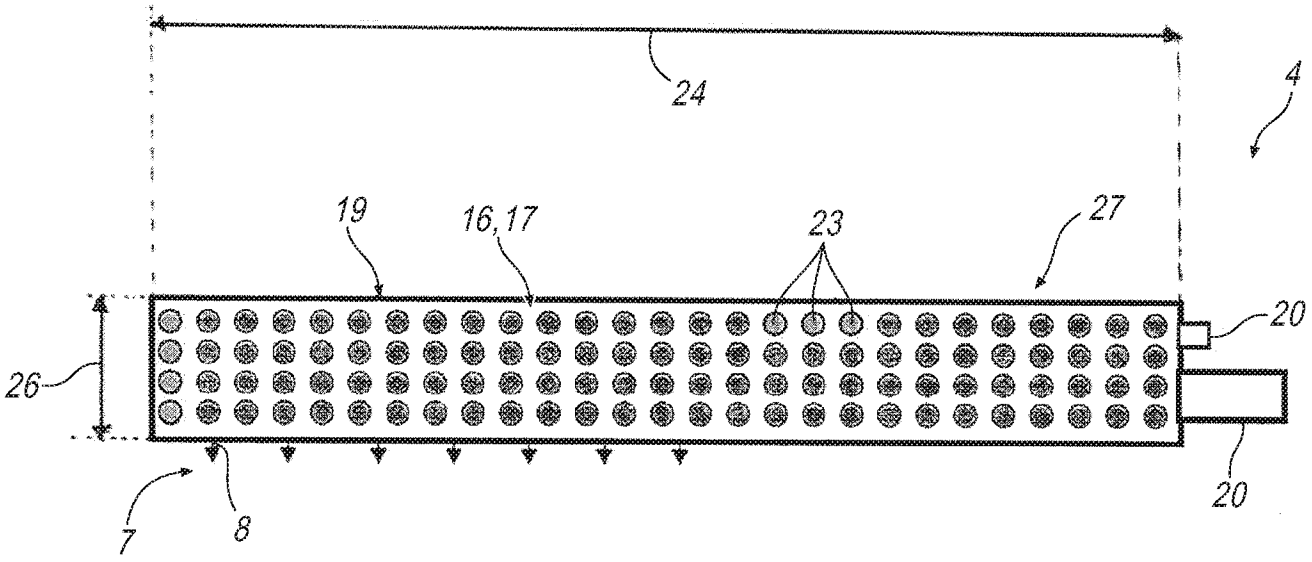
FIG. 4 shows a lateral view of another embodiment of the antistatic device.

FIG. 4 shows a further embodiment of the antistatic device 4. The variant of the antistatic device 4 shown in FIG. 4 compared with the examples in FIG. 2 and FIG. 3, comprises an increased number of illuminating units 23, in particular light-emitting diodes 23', which are evenly distributed over the entire side surface shown, i.e. over the entire length 24 and over the entire width 26 of the side surface. This means that the entire side surface shown is essentially translucent or transparent so that the signal output by the illuminating units 23 is observable from outside. With this variant the indicating means 17 extends over at least one further side surface, preferably over all side surfaces of the antistatic device 4. The housing 19 is thus used as an indicator or part of the indicating means 17, and due to the translucent or transparent design can "shine" when the respective signal is output. Thus signal output is very clear and the signal can be easily observed. The illuminating units 23, in particular the light-emitting diodes 23' and/or the translucent area 27 of the housing 19 are cast in the profile of the housing 19. Also, due to the increased number or density of the illuminating units 23 a text output or text output at an increased resolution may be effected by means of the illuminating units 23. The text output can be combined at random with the color outputs. As such colors and text can be output alternately or in different areas, simultaneously or alternately. It is also feasible to output or represent texts with different colors.

The invention claimed is:

1. An antistatic device for reducing electrostatic charges on moving material webs, comprising:

a housing having a longitudinal extension and including a plurality of wall sections together defining an interior;

at least one active electrode assembly including a plurality of active individual needle-shaped electrodes, the at least one electrode assembly during operation is electrically connected to an associated voltage source;

a controller for controlling the voltage source;

wherein the at least one active electrode assembly and the controller are arranged in the interior of the housing;

a signal device including an optical indicator arranged at least one of in and on the housing, the optical indicator configured to output an optical signal to a user, which signal correlates with at least one parameter of the material web, wherein the at least one parameter includes a polarity of the material web;

wherein the optical indicator extends along the longitudinal extension of the housing and circumferentially to the longitudinal extension along at least two of the plurality of wall sections to facilitate observation of the optical signal;

wherein the at least one active electrode assembly includes at least two active electrode assemblies, the at least two active electrode assemblies including an active positive electrode assembly with a plurality of positive electrodes and an active negative electrode assembly with a plurality of negative electrodes; and wherein the housing further includes a central web disposed in the interior and extending along the longitudinal extension between the positive electrode assembly and the negative electrode assembly, the central web composed of an electrically insulating material to electrically isolate the positive electrode assembly from the negative electrode assembly.

2. The antistatic device according to claim 1, further comprising a power electronics arranged in the interior of the housing, the power electronics including the voltage source and at least one of a voltage converter and a frequency converter.

3. The antistatic device according to claim 1, further comprising at least one primary connection arranged on the housing for connecting the power electronics to an external voltage source.

4. The antistatic device according to claim 1, further comprising a sensor system for capturing parameters of at least one of the antistatic device, the material web and an associated production plant which is connected to the controller, wherein the sensor system is arranged in the interior of the housing.

5. The antistatic device according to claim 1, wherein the controller is coupled to the signal device and configured to drive the signal device in response to at least one parameter captured by the sensor system.

6. The antistatic device according to claim 1, wherein the optical indicator is arranged in the interior of the housing, and wherein the housing has at least one of a translucent area and an optically transparent area disposed complementary to the optical indicator along the at least two of the plurality of wall sections.

7. The antistatic device according to claim 1, further comprising an environmental sensor for recognizing environmental parameters, the environmental sensor configured to vary the signal output by the signal device.

8. The antistatic device according to claim 1, further comprising at least one of a wireless communications interface and wired communications interface for communicating with another communications device.

9. The antistatic device according to claim 1, wherein the housing is at least partially filled with a casting compound and the at least one electrode assembly is electrically contacted with the casting compound, and wherein the casting compound is at least partially translucent at least in an area disposed complementary to the optical indicator.

10. A method for operating an antistatic device according to claim 1, comprising outputting, via the signal device, different signals in dependence of parameters of the material web, wherein at least one signal is output in dependence of the polarity of the material web.

11. The method according to claim 10, wherein a signal is output in dependence of a polarity of a neutralization current.

12. The method according to claim 10, further comprising outputting at least one of different colors and different texts in dependence of at least one such parameter of at least one of the antistatic device, the material web and a production plant.

13. The method according to claim 10, further comprising outputting different frequencies of the respective signal in dependence of at least one such parameter of at least one of the antistatic device, the material web and a production plant.

14. The method according to claim 10, further comprising outputting at least one of different color combinations and frequency combinations in dependence of at least one such parameter of at least one of the antistatic device, the material web and a production plant.

15. The method according to claim 10, further comprising outputting, via the optical indicator, a colored signal for an at least predominantly negative polarization, and a differently colored signal for an at least predominantly positive polarization.

16. The antistatic device according to claim 1, wherein the optical indicator includes a plurality of illuminating units disposed in the interior of the housing and distributed along the longitudinal extension of the at least two of the plurality of wall sections, and wherein the at least two of the plurality of wall sections are at least translucent in an area covering the plurality of illuminating units.

17. An antistatic device for reducing electrostatic charges on moving material webs, comprising:

an active positive electrode assembly including a plurality of active needle-shaped individual positive electrodes connected to a positive voltage source;

an active negative electrode assembly include a plurality of active needle-shaped individual negative electrodes connected to a negative voltage source;

a power electronics having a first unit electrically connected with the positive electrode assembly and a second unit electrically connected with the negative electrode assembly, wherein the respective units include the associated voltage source, a frequency converter and a voltage converter;

a controller for controlling the first unit and the second unit of the power electronics;

a sensor system in communication with the controller configured to detect parameters of at least one of the power electronics, the positive electrode assembly, the negative electrode assembly, the material web and a production plant;

a signal device having an optical indicator for outputting a signal to a user, the signal corresponding to at least one parameter of the material web, the at least one parameter including a polarity of the material web;

a housing having a longitudinal axis containing the positive electrode assembly, the negative electrode assembly, the power electronics, the controller, the sensor system and the signal device, wherein the housing includes at least one of a translucent section and an optically transparent section; and a central web composed of an electrically insulating material disposed in the housing, the central web extending transversely in the housing along the longitudinal axis and separating the positive electrode assembly and the first unit of the power electronics from the negative electrode assembly and the second unit of the power electronics;

wherein the optical indicator is arranged in an area of at least one of the translucent section and the optically transparent section.

18. The antistatic device according to claim 17, wherein the housing further includes a plurality of wall sections extending along the longitudinal axis, and wherein the optical indicator includes an arrangement of illuminating units extending along the longitudinal axis of the housing and circumferentially to the longitudinal axis along at least two of the plurality of wall sections to facilitate observation of the signal.

19. The antistatic device according to claim 17, wherein the housing is at least partially filled with a casting compound disposed in electrical contact with at least one of the positive electrode assembly and the negative electrode assembly, and wherein the casting compound is at least partially translucent in an area disposed complementary to the optical indicator.

* * * * *